5/24/83 XR 4,384,807

United States Patent [19]

Yamazaki

[11] 4,384,807

[45] May 24, 1983

[54] EXCAVATION CONTROLLING METHOD IN HYDRAULIC SHIELD TUNNELLING

[75] Inventor: Hironobu Yamazaki, Kashiwa, Japan

[73] Assignee: Tekken Construction Co., Ltd., Japan

[21] Appl. No.: 213,770

[22] Filed: Dec. 8, 1980

[30] Foreign Application Priority Data

Dec. 18, 1979 [JP] Japan ..... 54/163547

[51] Int. Cl.[3] ..... E21D 9/06

[52] U.S. Cl. ..... 405/141; 73/432 R; 175/48; 405/138

[58] Field of Search ..... 73/432 R; 299/1; 175/38, 48; 405/138, 141

[56] References Cited

U.S. PATENT DOCUMENTS 3,778,107 12/1973 Haspert ..... 299/11

4,040,666 8/1977 Uchida ..... 73/155

4,171,848 10/1979 Ono ..... 299/1

*Primary Examiner*—S. Clement Swisher

*Attorney, Agent, or Firm*—Leydig, Voit, Osann, Mayer and Holt, Ltd.

[57] ABSTRACT

An excavation controlling method for hydraulic shield tunnelling wherein decisions are made during advances of tunnel excavation on whether respective excavated soil amounts per macroscopic unit distance belong to the same statistic population and, with respect to excavated amounts per microscopic unit distance divided out of the macroscopic unit distance, whether excavated amounts per microscopic unit distance of the same dividing order belong to the same statistic population.

7 Claims, 3 Drawing Figures

EXCAVATION CONTROLLING METHOD IN HYDRAULIC SHIELD TUNNELLING

This invention relates generally to a hydraulic shield tunnelling method and, more particularly, to an excavation controlling method for hydraulic tunnelling with a shield-type excavator.

In hydraulic shield tunnelling, a pressurized slurry is fed to an underground shield excavator through a feeding pipe system from the exterior. The slurry is mixed in the excavator with ground forming materials excavated at tunnel face (the materials shall be referred to hereinafter simply as "soil") including any soil collapsed from the tunnel face, and is then discharged through a discharging pipe system to the exterior. The thus mixed and discharged slurry includes a solid component of the soil, which is settled and removed in a separating tank and the remaining water is again fed as a slurry into the excavator and through the feeding system. In practice, the slurry thus fed to the excavator through the feeding system still contains a certain amount of the solid component, and an electromagnetic flow meter and $\gamma$-ray densimeter are arranged in each of the feeding and discharging systems so that the amount of the solid component in the slurry fed through the feeding system and that in the mixed slurry discharged through the discharging system will be respectively detected through arithmetic operations and the amount of the soil actually excavated and discharged out of the excavator will be thereby detected, as has been already suggested in, for example, U.S. Pat. No. 4,040,666.

The actually excavated soil amount is generally determined by the amount the excavator has advanced in the tunnel. In order to prevent any underground collapse at the tunnel face specifically in a soft and unstable ground, the amount the excavator advances or stroke must be rather precisely controlled in relation to the amount of soil excavated. There has been suggested in a Japanese Laid-Open Patent Application Publication No. 54-94725 of July 26, 1979 a method of controlling the excavator stroke in hydraulic shield tunnelling, according to which signals denoting the respective predetermined advancing strokes of the shield excavator are employed to drive two recorders simultaneously with the excavator. The soil amounts excavated during such strokes are accumulatively recorded by the first recorders, with upper and lower control limit lines thereafter added to a chart sheet of the first recorder on which the excavated soil amounts are recorded. Then the chart sheet is set in the second recorder. Further soil amounts excavated during subsequent advancing strokes are recorded on this chart sheet by the second recorder responsive to the advancing strokes. The excavator advance during the subsequent strokes is controlled so that the excavated soil amounts will be within the two control limit lines during the subsequent strokes, and such recording and controlling are repeated for respective further advancing strokes. The thus detected amounts of excavated soil are varying momentarily but are usually not greatly different from a predetermined value and the excavation can properly progress. More specifically, with the progress of excavation for each predetermined distance, the detected amounts of the discharged soil (dry soil amount) are sampled to prepare a population. The mean value and standard deviation of this population are calculated and a control limit is determined. In other words, the excavator is stopped for being in an "abnormal" state when a detected value differs by more than a predetermined multiple of the standard deviation from the mean value, so that a proper measure can be taken for finding and removing the cause for the abnormality.

According to this method, however, even a population based on the latest data of, for example, 100 samplings of preceding excavations cannot be deemed to be accurately and faithfully representing the exact state of the tunnel face. That is, even when the tunnel face or its vicinity has varied in practice to be comparatively soft and unstable as a whole, influences of the preceding excavated positions remain in the population being used at that moment and it is difficult to decide any variation in geologic nature and possible collapse of the ground at the tunnel face on the basis of such population.

A primary object of the present invention is, therefore, to provide an excavation controlling method for hydraulic shield tunnelling which allows a proper control limit which faithfully represents any minute geologic variation in the tunnel face ground with the progress of tunnel excavation by means of the shield excavator, so as to render the tunnelling more safe.

Another object of the present invention is to provide a method for controlling hydraulic tunnelling with a shield excavator wherein an excavated soil amount discharged from the excavator is subjected to a sampling for each predetermined advancing distance of the excavator, the distance corresponding to the width of the respective tunnel wall reinforcing segments installed behind the excavator as the same is advanced, with decisions being made sequentially on whether or not each sampling value of the latest obtained soil amount belongs to the same population as that of a preceding sampling value for a preceding advancing distance and with the excavation control actuated in response to results of such decisions.

Still another object of the present invention is to provide a hydraulic shield tunnelling excavation control method which decides whether or not the sampling values sampled with respect to the respective advancing distances of the excavator for the respective tunnel wall reinforcing segments are belonging to a population including immediately preceding sampling values by means of the "$2\sigma$ method".

Yet another object of the present invention is to provide an excavation controlling method for hydraulic shield tunnelling which is performed by setting two sampling groups of excavated soil amounts respectively sampled for each repetitive advance of the excavator by a predetermined distance, one of the groups including the latest sampling value of the just excavated soil amount, and deciding whether or not these two sampling groups are merely two divisions of sampling values belonging substantially to the same population by means of an "analysis of variance by one-way layout", that is, whether or not the latest sampling value shows an abnormal state of the tunnel face.

A further object of the present invention is to provide a method of controlling hydraulic shield tunnelling excavation for safely performing the tunnelling by sampling the respective discharged soil amounts per a fixed interval, such as 2.5 cm for each tunnel-wall-reinforcing segment length of 100 cm in the tunnelling direction, forming a population with sampling values at respective sampling positions in the respective segment lengths and deciding whether or not sampling values at respective sampling positions of a new segment belong to the population by means of the "$2\sigma$ method".

A still further object of the present invention is to provide a method for precisely controlling the hydraulic shield tunnelling excavation wherein a macroscopic sampling treatment is made at intervals corresponding to the segment length, any macroscopic geological variation in the tunnel face ground is detected, a microscopic sampling treatment is made at the same time at minute intervals for each segment length and any microscopic geological variation representing any quick variation such as a collapse of the ground is detected.

Yet a further object of the present invention is to provide a quickly and automatically performable tunnel excavation control method by dividing the sampling treatments into macroscopic and microscopic treatments so as to reduce any load due to the sampling treatment and to enable it possible to employ comparatively inexpensive computing devices.

Other objects and advantages of the present invention will be self-evident to those skilled in the art in view of the following detailed description, with reference to preferred embodiments of the invention and by reference to the accompanying drawings, in which.

While the present invention shall be explained with reference to the preferred embodiments, the intention is not to limit the invention to the particular embodiments but rather to include all alternatives, modifications and equivalent arrangements possible within the scope of the appended claims.

Figure 1:
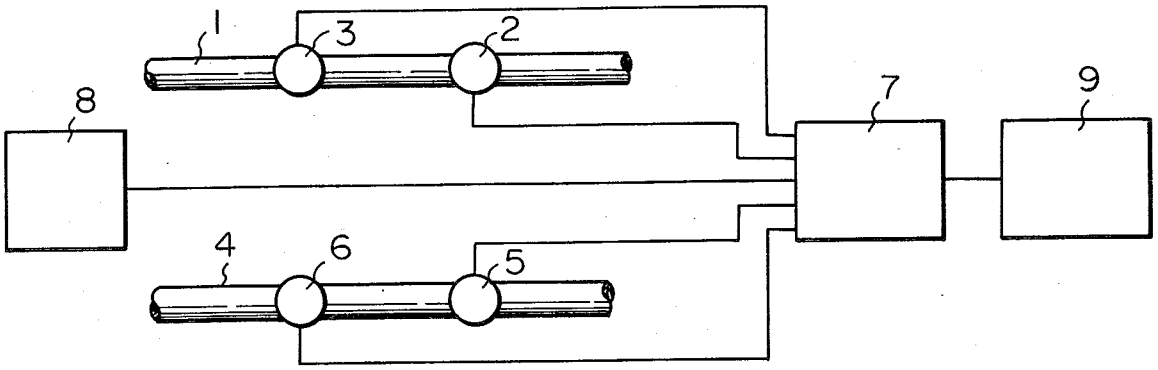
FIG. 1 is a fragmentary block diagram of an electric information system of a hydraulic shield tunnelling method to which the present invention is applied.

Referring now to FIG. 1, a pipe 1 forming a feeding system for feeding a slurry to an excavator from the exterior is provided with an electromagnetic flow meter 2 and $\gamma$-ray densimeter 3. A pipe 4 forming a discharging system for discharging a mixture of the slurry with excavated soil from the excavator to the exterior is also provided with an electromagnetic flow meter 5 and $\gamma$-ray densimeter 6. An arithmetic memory circuit 7 is connected to the respective meters 2,3 and 5,6 for calculating the amount of fed solid component contained in the slurry and fed to the excavator according to detected signals of the flow meter 2 and densimeter 3 in the feeding system and the amount of discharged solid component contained in the mixture discharged out of the excavator according to detected signals of the flow meter 5 and densimeter 6 in the discharging system. The amount of substantial excavated soil is computed by taking the difference between the two calculated amounts and storing this excavated soil amount. A detector 8 detects the protruded plunger stroke length of a jack for advancing the excavator and provides its detected signals to the arithmetic memory circuit 7. An indicating circuit 9 properly indicates the contents stored in the arithmetic memory circuit 7 and is manually prepared for macroscopic and microscopic sampling treatments.

The arithmetic memory circuit 7 stores the substantial excavated soil amount calculated on the basis of signals from the detector 8 whenever the excavator advances by 2.5 cm, that is, whenever the plunger stroke length of the jack reaches 2.5 cm. Usually, whenever the jack stroke length reaches 100 cm, the reinforcing segment is installed at the rear end of the excavator, the jack fixing position is advanced and then the excavator is again advanced by the jack. The arithmetic memory circuit 7 adds the stored excavated soil amounts for every interval of 2.5 cm and stores them as excavated soil amount per segment (a segment excavation amount $X_i$). At every time when each segment excavation amount $X_i$ is obtained, a mean value $\overline{X}$ and standard deviation $\sigma$ will be calculated. When a newly arriving segment excavation amount $X_{i+1}$ meets the following conditions, it will not be included in the population including the segment excavation amount $X_i$, that is, it will be an "abnormal" value which will be included in a population different from the particular population including the segment excavation amount $X_i$, the excavator will be manually or automatically stopped, the cause of the abnormality will be determined and necessary measures will be taken.

Deciding Condition I

When $|X_1-\overline{X}|>2\sigma$ and $|X_{i-11}-\overline{X}|>2\sigma$, then $X_{i-11}$ belongs to a different population.

Deciding Condition II

When $X_{i-4}-\overline{X}>0$, $X_{i-3}-\overline{X}>0$, $X_{i-2}-\overline{X}>0$, $X_{i-1}-\overline{X}>0$, $X_i-\overline{X}>0$ and $X_{i+1}-\overline{X}>0$ or $X_{i-4}-\overline{X}<0$, $X_{i-3}-\overline{X}<0$, $X_{i-2}-\overline{X}<0$, $X_{i-1}-\overline{X}<0$, $X_i-\overline{X}<0$ and $X_{i+1}-\overline{X}<0$, then $X_{i+1}$ belongs to a different population.

Deciding Condition III

When $\overline{X}+\sigma\leqq X_{i-1}$, $X_i$, $X_{i+1}\leqq\overline{X}+2\sigma$ or $\overline{X}-2\sigma\leqq X_{i-1}$ and $X_i$, $X_{i+1}\leqq\overline{X}-\sigma$, then $X_{i+1}$ belongs to a different population.

Deciding Condition IV

When $X_{i-4}-X_{i-5}>0$, $X_{i-3}-X_{i-4}>0$, $X_{i-2}-X_{i-3}>0$, $X_{i-1}-X_{i-2}>0$, $X_i-X_{i-1}>0$, and $X_{i+1}-X_i>0$ or $X_{i-4}-X_{i-5}<0$, $X_{i-3}-X_{i-4}<0$, $X_{i-2}-X_{i-3}<0$, $X_{i-1}-X_{i-2}<0$, $X_i-X_{i-1}<0$ and $X_{i+1}-X_i<0$, then $X_{i+1}$ belongs to a different population.

Deciding Condition V

When $\overline{X}-2\sigma\leqq X_{i-2}$, $X_{i-1}$, $X_i$, $X_{i+1}\leqq\overline{X}-\sigma$ or $\overline{X}+\sigma\leqq X_{i-2}$, $X_{i-1}$, $X_i$, $X_{i+1}\leqq\overline{X}+2\sigma$, then $X_{i+1}$ belongs to a different population.

Deciding Condition VI

When $R=|X_i-X_{i+1}|>2.83\sigma$, then $X_{i+1}$ belongs to a different population.

It will be clear that, at the time of starting the excavation, the segment excavation amount $X_i$ is not known yet and, therefore, the segment excavation amounts $X_s$ and standard deviation $\sigma_s$ are to be properly determined by the measuring precision of the electromagnetic flow meters 2 and 5, $\gamma$-ray densimeters 3 and 6 and detector 8, the excavating velocity of the excavator and the geological conditions.

Figure 2:
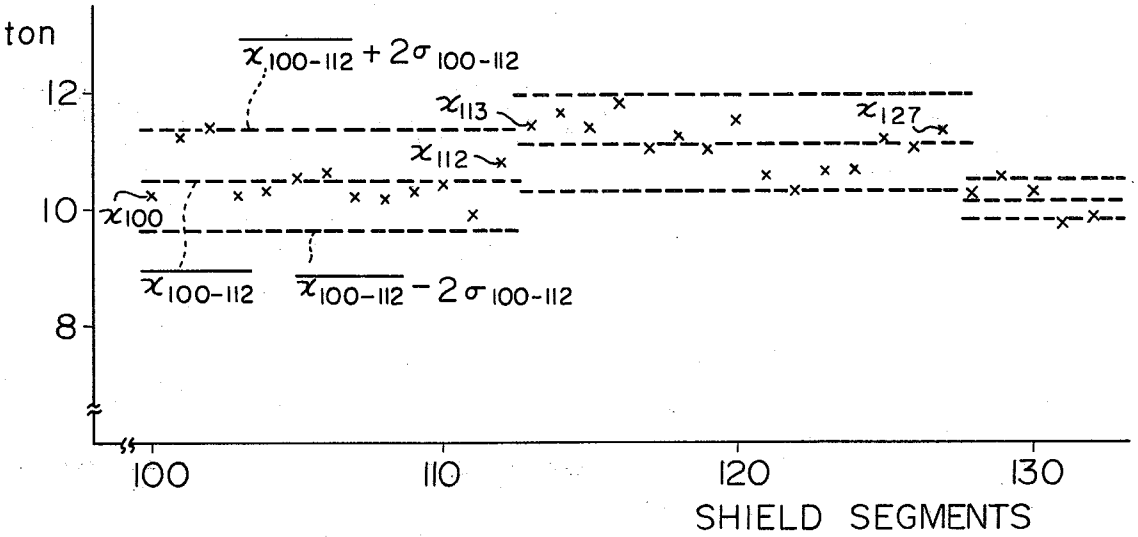
FIG. 2 is an explanatory diagram of a macroscopic sampling treatment of the present invention.

FIG. 2 is a diagram showing the foregoing deciding operation of the controlling method according to the present invention as indicated by the indicating circuit 9, or that operation performed within the arithmetic memory circuit 7. It should be here assumed that, at a stage where the calculations are made up to a segment excavation amount $X_{112}$ corresponding to the 112th reinforcing segment, this segment excavation amount $X_{112}$ is found to belong to the same population as of the respective preceding segment excavation amounts $X_{100}$ to $X_{111}$. The mean value $\overline{X_{100\text{-}112}}$ and standard deviation $\sigma_{100\text{-}112}$ for the segment excavation amounts $X_{100}$–$X_{112}$ are calculated and the upper control limit $\overline{X_{100\text{-}112}}+2\sigma_{100\text{-}112}$ and lower control limit $\overline{X_{100\text{-}112}}-2\sigma_{100\text{-}112}$ are illustrated respectively in the diagram with broken lines. Even in a state where a further segment excavation amount $X_{113}$ corresponding to the 113th segment is calculated, the same arithmetic operation is carried out. As will be clear when the deciding condition I is considered in a state where a segment excavation amount $X_{114}$ corresponding to the 114th segment is calculated, the respective segment excavation amounts $X_{113}$ and $X_{114}$ will fall under this condition I and, therefore, the amount $X_{114}$ will be decided to belong to a different population. In accordance with this, the excavator will be stopped, and any cause for the abnormality will be determined and removed before continuing the subsequent operations. While FIG. 2 shows the further results of continued excavating and deciding operations, they will be almost self-evident from the foregoing descriptions and their explanations shall be omitted, but it should be simply noted that as the respective segment excavation amounts $X_{100}$ to $X_{112}$, $X_{113}$ to $X_{127}$ and $X_{128}$ to $X_{132}$ are shown as forming respectively different populations, decision making zones derived from the mean values and standard deviations of the respective populations will vary in such manner as illustrated.

Not only the above described, "$2\sigma$ method" but also the following "analysis of variance by one-way layout" can be adopted in the controlling method of the present invention. For the purpose of simplicity, the explanation shall be made by using the segment excavation amounts plotted in FIG. 2. When the segment excavation amount $X_{113}$ is calculated, the already calculated excavation amounts for the respective segments are divided into a first group of the earlier obtained amounts $X_{109}$, $X_{110}$ and $X_{111}$ and a second group of the later obtained amounts $X_{112}$ and $X_{113}$. The "analysis of variance by one-way layout" is performed between these two groups to compare them with each other. Then, in the present instance, it is confirmed that uniformity exists between both groups and the excavation is continued for the next segment length, for which a segment excavation amount $X_{114}$ is calculated. At this time, the already known excavation amounts are similarly divided into a first group of the earlier obtained amounts $X_{110}$, $X_{111}$ and $X_{112}$ and a second group of the later obtained amounts $X_{113}$ and $X_{114}$, the "analysis of variance by one-way layout" is made between these groups to compare them with each other, and their uniformity will be denied in the present instance as seen in the drawing. At this time, the excavator will be stopped to check and remove any cause for an abnormality denoted by the nonuniformity. Thereafter, the excavation will be continued in the same manner as has been described in the foregoing.

By the foregoing descriptions, the macroscopic sampling treatment of the present invention can be carried out.

In addition, in the present invention, the microscopic sampling treatment is made for each segment to accelerate the controlling operation and to simplify and economize the controlling device.

Figure 3:
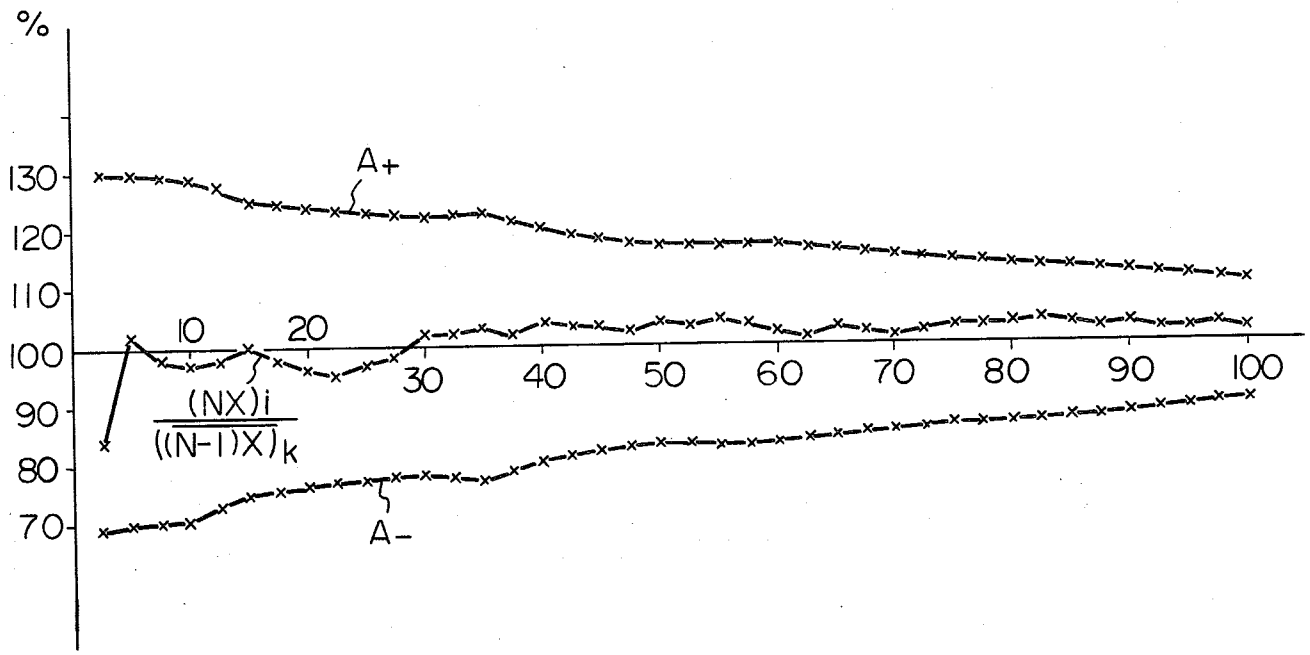
FIG. 3 is an explanatory diagram of a microscopic sampling treatment of the present invention.

The microscopic sampling treatment is made by deciding whether the before described excavated amounts stored in the arithmetic memory circuit 7 at every excavator advance of 2.5 cm, that is, at every protrusion by 2.5 cm of the jack plunger, are present in a desired range or not. For simplifying the following explanation, symbols shall be attached to these excavated amounts. The part corresponding to Nth segment is now being excavated, the "i"th excavated amount of every 2.5 cm excavation is expressed as $(NX)_i$ and the excavated amounts $(nX)_k$ up to $(N-1)$th segment are grouped by nothing "k". Statistics are taken among the excavated amounts $(NK)_k$ in which "k" is the same and the mean value $\overline{((N-1)X)_k}$ and standard deviation $\sigma_{N-1)2K}$ are determined.

$$\frac{\overline{((N-1)X)_k} \pm 2\sigma_{(N-1)}\cdot K}{\overline{((N-1)X)_k}} \equiv A_{\pm}$$

is plotted in the indicating circuit 9 as in FIG. 3 or is stored in the arithmetic memory circuit 7. Then, $(NX)_i\sqrt{((N-1)X)_k}$ is indicated by the indicating circuit 9 as shown in FIG. 3 and whether $$A_- \leqq (NX)_i\sqrt{((N-1)X)_k} \leqq A_+$$

holds or not is decided by sight. It will be clear that this decision may be of course made in the arithmetic memory circuit 7. If the above decision formula is satisfied—it is satisfied at every point in the case of FIG. 3—the excavation will be continued. If it is not satisfied, the excavator will be stopped, the cause of the abnormality will be determined and proper measures will be taken.

At the time of starting the excavation, the excavated amount and standard deviation shall be properly set in advance in the same manner as in the foregoing macroscopic sampling treatment.

In determining the cause for the abnormality on the basis of the macroscopic and microscopic sampling treatments for the control method according to the present invention, fluctuation pattern and the like of the thus theoretically calculated values due to ground layer variations and ground collapses are considered as will be evident to those skilled in the art and its explanation shall be omitted.

What is claimed is:

1. An excavation controlling method for hydraulic shield tunnelling wherein a slurry is fed to a shield type excavator through a feeding system from the exterior and a mixture of said slurry with soil excavated by said excavator is discharged out through a discharging system, said method comprising steps of (a) detecting the solid component amounts contained in said fed slurry, (b) detecting the solid component amounts contained in said mixture, (c) obtaining the actually excavated soil amount per unit excavation distance from the respective said solid component amounts determined in steps (a) and (b) during the advances of said excavator, and sequentially storing a plurality of thus obtained soil amounts actually excavated, (d) obtaining the mean value and standard deviation of said plurality of actually excavated soil amounts sequentially stored, (e) preparing from said mean value and standard deviation a predetermined deciding zone for administrating said actually excavated soil amount, (f) comparing the latest actually excavated soil amount per unit excavation distance with said deciding zone, and (g) stopping the excavator when said latest actually excavated soil amount is out of said deciding zone.

2. An excavation controlling method according to claim 1 wherein said deciding zone is expressed as $(\overline{X}-2\sigma, \overline{X}+2\sigma)$ in which $\overline{X}$ is said mean value and $\sigma$ is said standard deviation of a population including said excavated amount of an immediately preceding unit excavation distance.

3. An excavation controlling method according to claim 1 wherein said steps (a) to (c) are performed for respective minute unit excavation distances dividing said unit excavation distance, said step (d) is performed for respective said actually excavated amounts of said minute excavation distances of the same dividing order in a plurality of the unit excavation distances, and said step (e) is performed for the respective actually excavated amounts of the minute unit excavation distances of the same dividing order in the latest unit excavation distance.

4. An excavation controlling method according to claim 3 wherein said deciding zone is expressed as $(\overline{Y}-2\sigma, \overline{Y}+2\sigma)$ in which $\overline{Y}$ is said mean value and $\sigma$ is said standard deviation of said excavated amounts of said minute unit excavated distances of the same dividing order.

5. An excavation controlling method for hydraulic shield tunnelling wherein a slurry is fed to a shield type excavator through a feeding system from the exterior and a mixture of said slurry with soil excavated by said excavator is discharged out through a discharging system, said method comprising steps of (a) detecting the solid component amounts contained in the fed slurry, (b) detecting the solid component amounts contained in said mixture, (c) obtaining the actually excavated soil amount per unit excavation distance from respective said solid component amounts detected at said steps (a) and (b) during advances of the excavator, and sequentially storing a plurality of thus obtained soil amounts actually excavated, (d) dividing said plurality of actually excavated soil amounts stored at said step (c) into a first group of the excavated soil amounts of at least the two latest unit excavation distances and a second group of the excavated soil amounts of other preceding unit excavation distances and subjecting said first and second groups of the excavated soil amounts to the analysis of variance by one-way layout, and (e) stopping the excavator when analyzed results of said step (d) for the first and second groups are out of the uniformity to each other.

6. A method according to claim 5 wherein said steps (a) to (c) are performed for respective minute unit excavation distances dividing said unit excavation distance, said step (d) is performed for respective said actually excavated amounts of said minute unit excavation distances of the same dividing order in a plurality of the unit excavation distances, and said step (e) is performed for the respective actually excavated amounts of the minute unit excavation distances of the same dividing order in the latest unit excavation distance.

7. A method according to claim 5 wherein said deciding zone is expressed as $(\overline{Y}-2\sigma, \overline{Y}+2\sigma)$ in which $\overline{Y}$ is said mean value and $\sigma$ is said standard deviation of said excavated amounts of said minute unit excavated distances of the same dividing order.

* * * * *